US006328429B1

(12) United States Patent
Tajima et al.

(10) Patent No.: US 6,328,429 B1
(45) Date of Patent: Dec. 11, 2001

(54) INK JET RECORDING HEAD AND INK JET RECORDING APPARATUS

(75) Inventors: Hiroki Tajima; Yutaka Koizumi, both of Yokohama; Kiyomi Aono, Kawasaki; Tsutomu Abe, Isehara; Takeshi Okazaki, Sagamihara; Kouichi Omata, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/542,928

(22) Filed: Apr. 4, 2000

(30) Foreign Application Priority Data

Apr. 6, 1999 (JP) ..... 11-098415

(51) Int. Cl.[7] ..... B41J 2/05
(52) U.S. Cl. ..... 347/63; 347/18
(58) Field of Search ..... 347/18, 61, 62, 347/63, 64, 65, 205; 257/707, 713, 719

(56) References Cited

U.S. PATENT DOCUMENTS 5,164,747 11/1992 Osada et al. ..... 347/19
5,343,227 8/1994 Tajima ..... 347/27
5,612,724 * 3/1997 Murakami et al. ..... 347/64
5,621,243 * 4/1997 Baba et al. ..... 257/712

FOREIGN PATENT DOCUMENTS 8-290600-A * 11/1996 (JP) ..... B41J/2/335

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

An ink jet recording head including a base plate substrate formed by a first base plate substrate and a second base plate substrate in which the thermal expansion coefficient of the first base plate substrate directly in contact with a substrate having discharge energy generating elements arranged thereon is smaller than that of the second base plate substrate and the first base plate substrate is formed by material having the thermal expansion coefficient closer to that of the substrate having the discharge energy generating elements arranged therefor, and at the same time, the first base plate substrate, above which the discharge energy generating elements are placed, is supported by a surface of the second base plate substrate and a side face in the longitudinal direction of the second base plate substrate.

10 Claims, 4 Drawing Sheets

| COEFFICIENT OF THERMAL EXPANSION | |
|---|---|
| · SILICON | $0.42\times10^{-5}$ |
| · ALUMINIUM | $2.37\times10^{-5}$ |
| · AMORPHOUS CARBON | $0.32\times10^{-5}$ |
| · ALUMINIUM NITRIDE | $0.47\times10^{-5}$ |
| · ALUMINA | $0.72\times10^{-5}$ |

INK JET RECORDING HEAD AND INK JET RECORDING APPARATUS

BACKGROUND OF THE INVENTION

1. Field of the Invention

The present invention relates to an ink jet recording head and an ink jet recording apparatus. More particularly, the invention relates to an ink jet head provided with a ceiling plate and a substrate, which is structured by a plurality of ink flow paths and a common liquid chamber communicated with ink discharge ports by bonding the ceiling plate and the substrate together in order to discharge ink by means of discharge energy generating elements for the execution of recording. The invention also relates to an ink jet recording apparatus formed with such ink jet recording head.

2. Related Background Art

The ink jet recording method is such that when recording is executed, ink droplets are allowed to fly from fine discharge ports which are provided for an ink jet head. Then, with the ink droplets thus impacted on a recording medium, a desired recording is performed.

Conventionally, for a recording apparatus that records on paper sheets, cloths, plastic sheets, and OHP sheets, among some others, there have been proposed various recording methods, such as wire-dot method, thermosensitive recording method, heat transfer method, and a recording apparatus having an ink jet head using the ink jet method mounted thereon. Among such methods, the recording apparatus that uses the ink jet method (that is, the ink jet apparatus) is utilized as output means provided for an information processing system, such as a copying machine, a facsimile equipment, an electronic typewriter, a word processor, or as a printer serving as the output terminal of a work station or a handy or portable printer provided for a personal computer, a host computer, a disk device, a video equipment, or the like. Such recording apparatus has been merchandized and put on the market widely.

As the discharge energy generating element that generates energy for discharging ink from the discharge ports of the ink jet head of the ink jet apparatus, there is the one that utilizes electromechanical transducing devices such as piezo-elements. There is also the one that generates heat by the irradiation of electromagnetic wave in order to discharge ink droplets by the thermal action thus arranged, or the one that discharges ink droplets by heating liquid using electrothermal transducing elements provided with heating resistors, among some others.

Also, for the ink jet apparatuses that have been developed in the recent years, it is required to output color images along with the advancement of software and computer technologies. To cope with such situations, the ink jet heads are also made capable of dealing with color images. In addition to such color imaging requirement as this, ink jet recording is required to output color images in higher precision. Therefore, it is attempted to implement making images in higher precision and higher quality with the provision of higher print density, as well as by changing the densities of ink more suitably.

Now, for the ink jet method that discharges ink droplets by heating liquid with the heating resistors, it is generally practiced to use silicon for the formation of the substrate having discharge energy generating elements (such as electrothermal transducing elements) provided therefor.

Then, the ink jet recording head is formed to discharge ink by use of the discharge energy generating elements for the execution of recording in such a manner that the aforesaid substrate is bonded to the ceiling plate, which is provided with grooves that become a plurality of ink flow paths communicated with a plurality of ink discharge ports, and also, provided with a recessed portion that becomes the common liquid chamber communicated with the ink flow paths, for the formation of these ink flow paths and the common liquid chamber. For the conventional ink jet recording head thus formed, the silicon substrate having the discharge energy generating elements arranged therefor to discharge ink is die bonded directly to the aluminum base plate substrate which is standardized for the provision of a head.

When the die bonding is executed, a bonding agent 22 such as silver paste, which has a good heat conductivity, is used so that the heat of the silicon substrate which becomes higher due to the generation of the thermal energy is radiated by transferring it to the aluminum base plate substrate quickly. In this way, it is arranged to eliminate the accumulation of intense heat in the silicon substrate, hence making it possible to obtain good prints even at a printing of higher frequency.

However, if the aforesaid ink jet recording head a is formed with a substrate having a printing width of more than one inch, at the same time, the recording density (the arrangement density of the discharge energy generating elements) thereof being made 600 dpi or more, a drawback may be encountered that the silicon substrate 20 is warped or cracked due to the strong bonding force exerted by the bonding agent 22 used for the die bonding, because the silicon substrate 20 is die bonded directly to the aluminum base substrate 21 (see FIG. 4). More specifically, in a case where a silicon substrate 20 having the printing width of more than one inch is die bonded to an aluminum base plate substrate 21, the thermal expansion coefficient of the aluminum base plate becomes as extremely great as $2.37\times10^{-5}$ against that of the silicon substrate which is $0.42\times10^{-5}$ as shown in FIG. 3. Then, these substrates are bonded usually at a cure temperature of as high as 120° C. to 150° C. approximately. Therefore, the ratio of shrinkage between the silicon substrate 20 and the aluminum base plate substrate 21 is different when returned to the room temperature. Then, as shown in FIG. 4, for example, warping may take place on the substrate 20 in the arrangement direction of the discharge energy generating element. As a result, it becomes difficult to bond the ceiling plate and the substrate in parallel and smoothly in flat. A gap is made on the substrate inevitably between each of the adjacent ink flow paths, hence dispersing the discharge pressure exerted by each of the discharge energy generating elements to the adjacent ink flow paths, respectively. In this manner, the speed of ink discharges becomes instable when recording is made. Also, the accuracy of impact becomes degraded to bring about printing disturbance easily, hence making it difficult to implement recording in higher quality.

On the other hand, if the silicon rubber bonding agent or the like which may absorb the difference in the thermal expansion coefficient between them is used for die bonding in order to avoid the cracking or warping of the silicon substrate, it becomes difficult to radiate heat to the aluminum base plate when the target density is as high as 600 dpi or more. Consequently, the residual heat is inevitably accumulated in the silicon substrate to make it impossible to obtain good prints particularly when printing is made at a high frequency.

Further, for the conventional ink jet recording head, it is arranged to give criteria to the aluminum base plate for assembling a head. Therefore, due to the expansion of aluminum caused by generated heat during printing, the distance between the abutting reference on the carriage and the discharge nozzles tends to be expanded. Hence, a problem is encountered among some others that it becomes difficult to obtain the dot impact position in good accuracy.

SUMMARY OF THE INVENTION

With a view to solving the problems encountered in the conventional art as discussed above, the present invention is designed. It is an object of the invention to provide an ink jet recording head formed by a substrate having an elongated recording width, in particular, or having a higher recording density, which is still capable of maintaining a sufficient heat radiation performance when the substrate having discharge energy generating elements arranged thereon is bonded to the base plate, and bonding the substrate having the discharge energy generating elements arranged thereon and the ceiling plate in parallel and smoothly in flat without causing warping or cracking on the substrate having the discharge energy generating elements arranged thereon to make it possible to attain recording in high quality. The invention is also aimed at providing an ink jet recording apparatus using such ink jet recording head.

In order to achieve the objectives described above, the ink jet recording head and the ink jet recording apparatus are structured as given below. In other words, the ink jet recording head of the present invention comprises a ceiling plate; and a substrate on a base plate substrate having on the upper face thereof a plurality of discharge energy generating elements for discharging ink. Then, the ceiling plate is provided with grooves to form a plurality of ink flow paths communicated with a plurality of ink discharge ports, respectively, and a recessed portion to form a common liquid chamber communicated with the plurality of ink flow paths, and when the ceiling plate is bonded with the substrate, a plurality of ink flow paths and the common liquid chamber are formed to discharge ink by means of the discharge energy generating elements for the execution of recording. For this ink jet recording head, the base plate substrate is formed by a first base plate substrate and a second base plate substrate, and a thermal expansion coefficient of the first base plate substrate directly in contact with the substrate having the discharge energy generating elements arranged therefor is smaller than that of the second base plate substrate, and the first base plate substrate is formed by material having the thermal expansion coefficient closer to that of the substrate having the discharge energy generating elements arranged therefor, and the first base plate substrate is supported by the reverse side of the surface of the second base plate substrate having thereon the discharge energy generating elements, and the side face in the longitudinal direction thereof.

Also, for the ink jet recording head of the present invention, the substrate having the discharge energy generating elements arranged therefor is formed by silicon, and the second base plate substrate is formed by aluminum.

Also, for the ink jet recording head of the invention, the first base plate substrate is formed by either one of amorphous carbon, aluminum nitride, and alumina.

Also, for the ink jet recording head of the invention, the first base plate substrate has an X reference and a Y reference as criterion for an ink jet recording head.

Also, for the ink jet recording head of the invention, the first base plate substrate and the second base plate substrate are bonded by a bonding agent capable of absorbing the difference in expansion due to the difference in the thermal expansion coefficients.

Also, for the ink jet recording head of the invention, a wiring substrate is provided for the second base plate substrate, and the wiring substrate and the substrate are electrically connected.

Also, for the ink jet recording head of the invention, the ink jet recording head has an arrangement density of discharge energy generating elements of 600 dpi or more.

Also, for the ink jet recording head of the invention, the ink jet recording head has a recording width of one inch or more.

Also, for the ink jet recording head of the invention, the ink jet recording head has a substrate having an elongated recording width or having a higher recording density.

Also, the ink jet recording apparatus of the invention is provided with either one of the ink jet recording heads referred in the preceding paragraphs, and a capping member for capping a discharge port formation portion of the ink jet recording head used therefor.

BRIEF DESCRIPTION OF THE DRAWINGS

FIG. 1A is the plan view; FIG. 1B, the front view; and FIG. 1C, the side view thereof.

DETAILED DESCRIPTION OF THE PREFERRED EMBODIMENTS

With the structure described above, an ink jet recording head is formed by a substrate which has the printing width of equal to or more than one inch in particular or formed to provide a recording density of 600 dpi or more. In accordance with the present invention, however, there is no possibility that any warping or cracking takes place on the substrate having the discharge energy generating elements arranged therefor due to the difference in the thermal expansion coefficients when such substrate is bonded to the base plate, because the heat radiation performance is maintained sufficiently. As a result, it becomes possible to bond the substrate having the discharge energy generating elements arranged therefor and the ceiling plate in parallel and smoothly in flat, and to implement recording in high quality. Particularly, it is possible to demonstrate the effect more efficiently by use of the base plate substrate which is formed by the material having a closer coefficient of thermal expansion to that of the substrate having the discharge energy generating elements arranged therefor, such as amorphous carbon, aluminum nitride, alumina.

Embodiments

Hereinafter, the description will be made of the embodiments in accordance with the present invention.

Figure 1A:
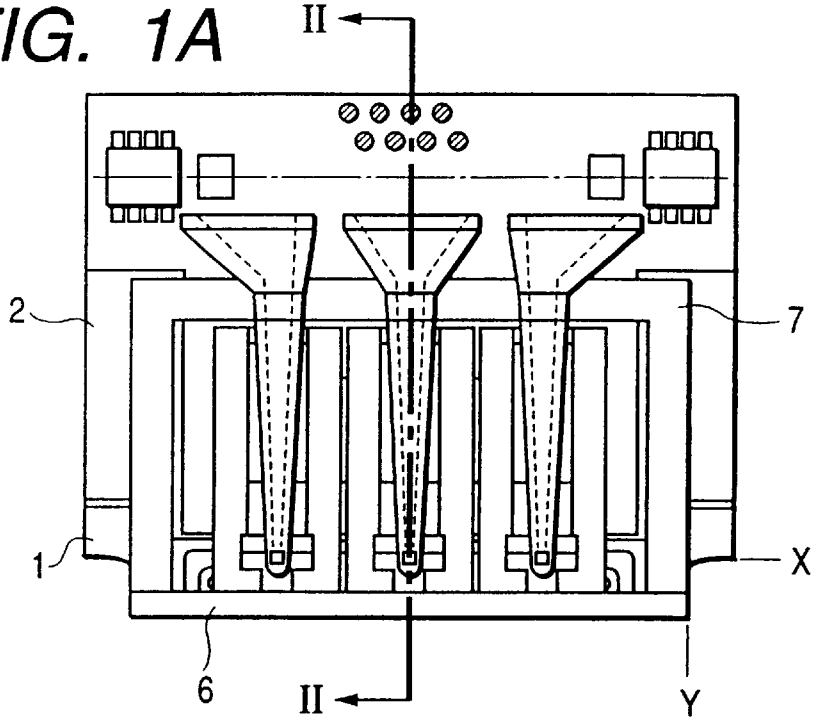
FIGS. 1A, 1B and 1C are views which illustrate the structure of an ink jet recording head formed by a substrate having a printing width of equal to or more than one inch in accordance with one embodiment of the present invention.
Figure 1B:
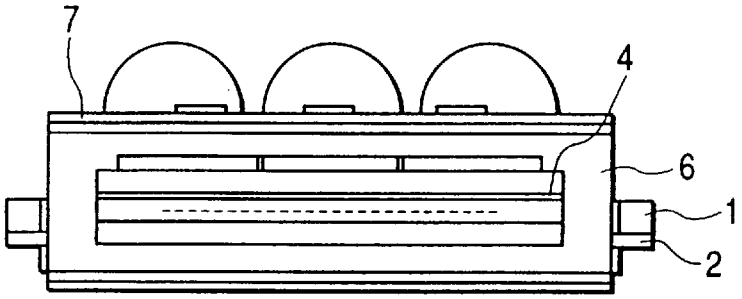
Figure 1C:
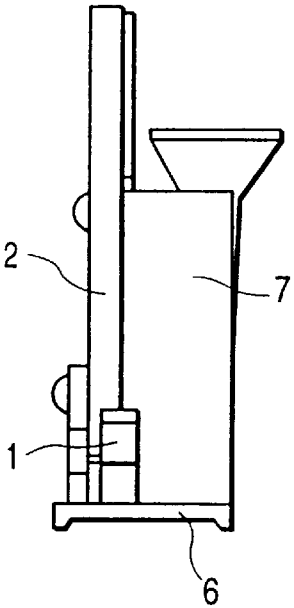

FIGS. 1A to 1C are views which illustrate the structure of an ink jet recording head formed by a substrate having the printing width of more than one inch in accordance with one embodiment of the present invention In FIG. 1A, the base plate substrate is formed in the two-layered structure where a base plate substrate 1 is arranged on a base plate substrate 2. Here, the substrate 1 supports the silicon substrate and is provided with the X reference and the Y reference as the criteria of the head when mounted on an apparatus. Then, the silicon substrate is bonded to the substrate 1 with a bonding agent having good heat conductivity, such as silver paste. The ceiling plate member 4 having the orifice plate 10 formed therefor is pressed from above onto the silicon substrate 5 by use of a spring. For the ceiling plate 4, there are formed grooves that become a plurality of ink flow paths 11 communicated with ink discharge ports, respectively, and the recessed portion that becomes the common liquid chamber 12 which is communicated with the plural ink flow paths 11. Then, with the ceiling plate being bonded to the silicon substrate 5, the ink flow paths 11 and the common liquid chamber 12 are formed. On the other hand, the substrate 2 is formed by aluminum material to support the PCB (printed-circuit board) assembled on the rear side of the silicon substrate. Further, from above, a chip tank 7 is covered it. Thus, ink is supplied to the ceiling plate member 4 by means of the ink supply unit provided for the chip tank 7. Also, the face member 6 is arranged on the ink discharge port surface side to form the area where capping is possible, and the cap abutting surface is formed mainly by the face member 6 and the orifice plate 10. Thus, the face member 6 may also function to protect the end portion of the aluminum base plate substrate 2.

Figure 2:
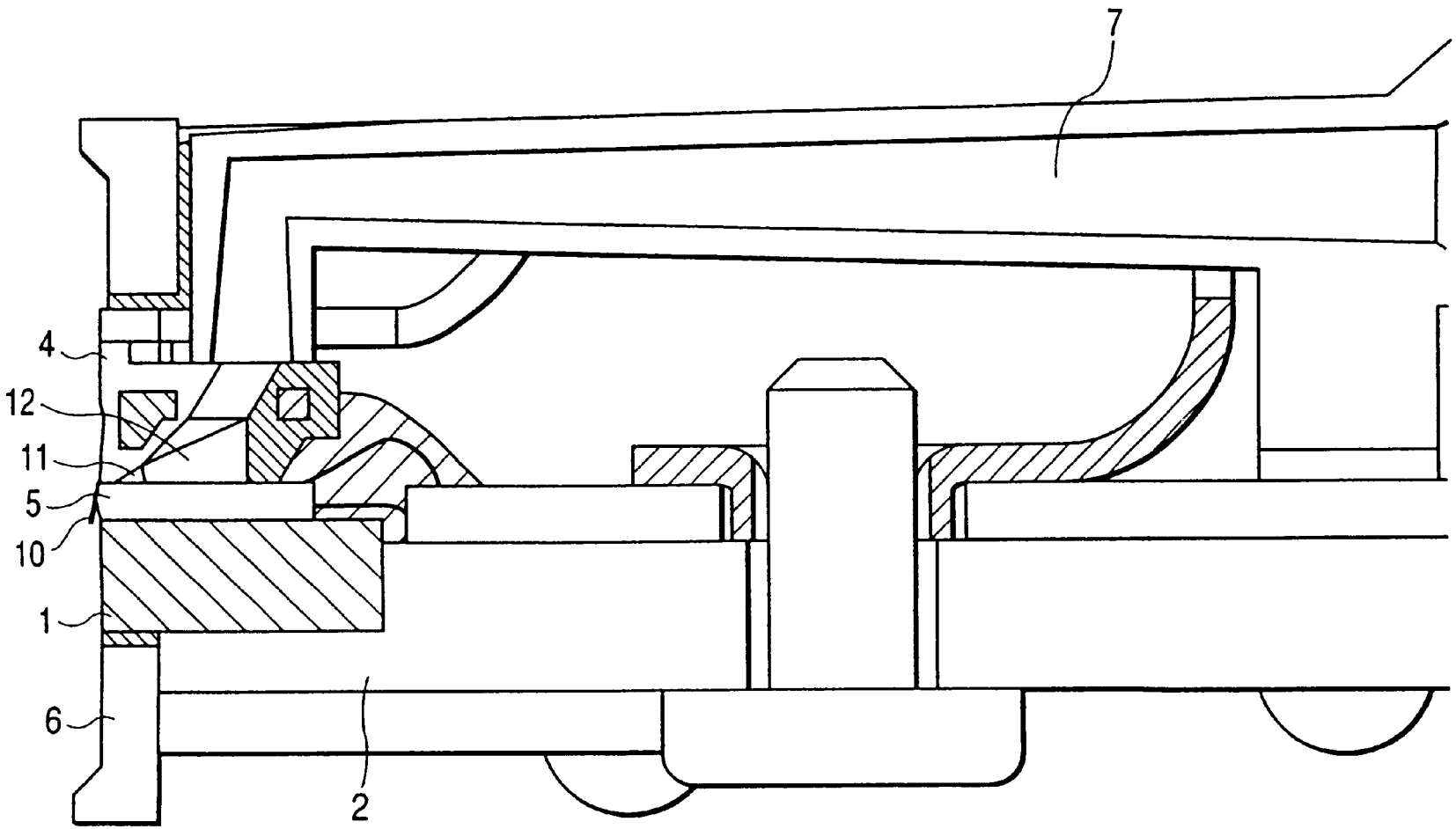
FIG. 2 is a cross-sectional view taken along line II—II in FIG. 1A.

FIG. 2 is a cross-sectional view taken along line II—II in FIG. 1A, which shows the two-layered structure of the base plate substrate representing the features of the present invention most suitably.

Figures 3, 4:
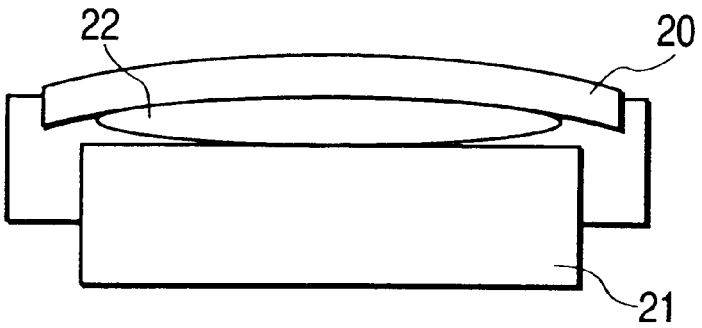
FIG. 4 PRIOR ART
FIG. 3 is a view which shows the thermal expansion coefficient of each kind of materials.
FIG. 4 is a view which illustrates the occurrence of warping on a discharge energy generating element of a silicon substrate in the arrangement direction thereof, which is brought about by the difference in the thermal expansion coefficients when the conventional silicon substrate and the aluminum base palate are bonded.

The heater board (silicon substrate) 5 which generates the discharge energy for ink discharges is the source that may cause the temperature to rise. Here, therefore, it is preferable to make the thermal expansion coefficients of the silicon substrate 5 and the substrate 1 extremely close to each other, because these members are die bonded by use of a bonding agent having good conductivity, such as silver paste, which has an extremely strong bonding power. For the present invention, it is more effective to adopt amorphous carbon as the material of the aforesaid substrate 1, because its thermal expansion coefficient is as extremely small as $0.32\times10^{-5}$, which is extremely close to that of the silicon substrate 5 (see FIG. 3). Also, from the viewpoint of the thermal expansion coefficient, aluminum nitride has an extremely small thermal expansion coefficient, which is $0.47\times10^{-5}$ and extremely close to that of the silicon substrate. This is good enough to be used for an ink jet recording head. The aluminum nitride may be adopted for use of the substrate 1. Further, it may be possible to use alumina for the substrate 1. In this manner, it becomes possible to solve the problem of the warping or cracking due to the comparatively large value of thermal expansion coefficient, $2.37\times10^{-5}$, that aluminum has against that of the silicon substrate, which is $0.42\times10^{-5}$. Also, the material of the substrate 1, which has been described above, has a lower heat radiation eventually as compared with the conventional aluminum material. In accordance with the present invention, therefore, the size of the substrate 1 is minimized for the purpose of maintaining the heat radiation capability. Then, in order to transfer heat from aluminum to the substrate 2 as quickly as possible, the structure is arranged so that the side face of the substrate 1 is supported by the substrate 2 in the longitudinal direction thereof in addition to the bottom face (the reverse side of the discharge energy generating elements formation surface) of the substrate 1. With the structure thus arranged, it becomes possible to maintain the heat radiation performance sufficiently.

Further, with the structure in which the substrate 2 supports the side face of the substrate 1 in the longitudinal direction thereof in addition to the bottom face of the substrate 1, it becomes possible to make the stepping difference smaller between the PCB formed for the substrate 2, and the silicon substrate 1 (in accordance with the present embodiment, these are formed substantially on one and same plane). Thus, it is possible to obtain good bonding condition when the silicon substrate and the PCB electrically connected by means of wire bonding. The production yield of the head is also improved significantly.

Also, since the substrate 1 and the substrate 2 absorb the difference in expansion, which has been brought about by the difference in the thermal expansion coefficients, it is preferable to bond them by use of silicon rubber bonding agent or the like.

Also, if ceramics material is used for the substrate 1, it may be possible to enforce the strength by use of the substrate 2 in such structure as described above.

Here, it may be possible to adopt a method in which the substrate 1 and the substrate 2 are integrated by use of the material whose thermal expansion coefficient is small. However, a material of the kind is expensive. It is not advisable to use such material, either, simply from the viewpoint of making the volume thereof as small as possible.

An Ink Jet Recording Apparatus

Figure 5:
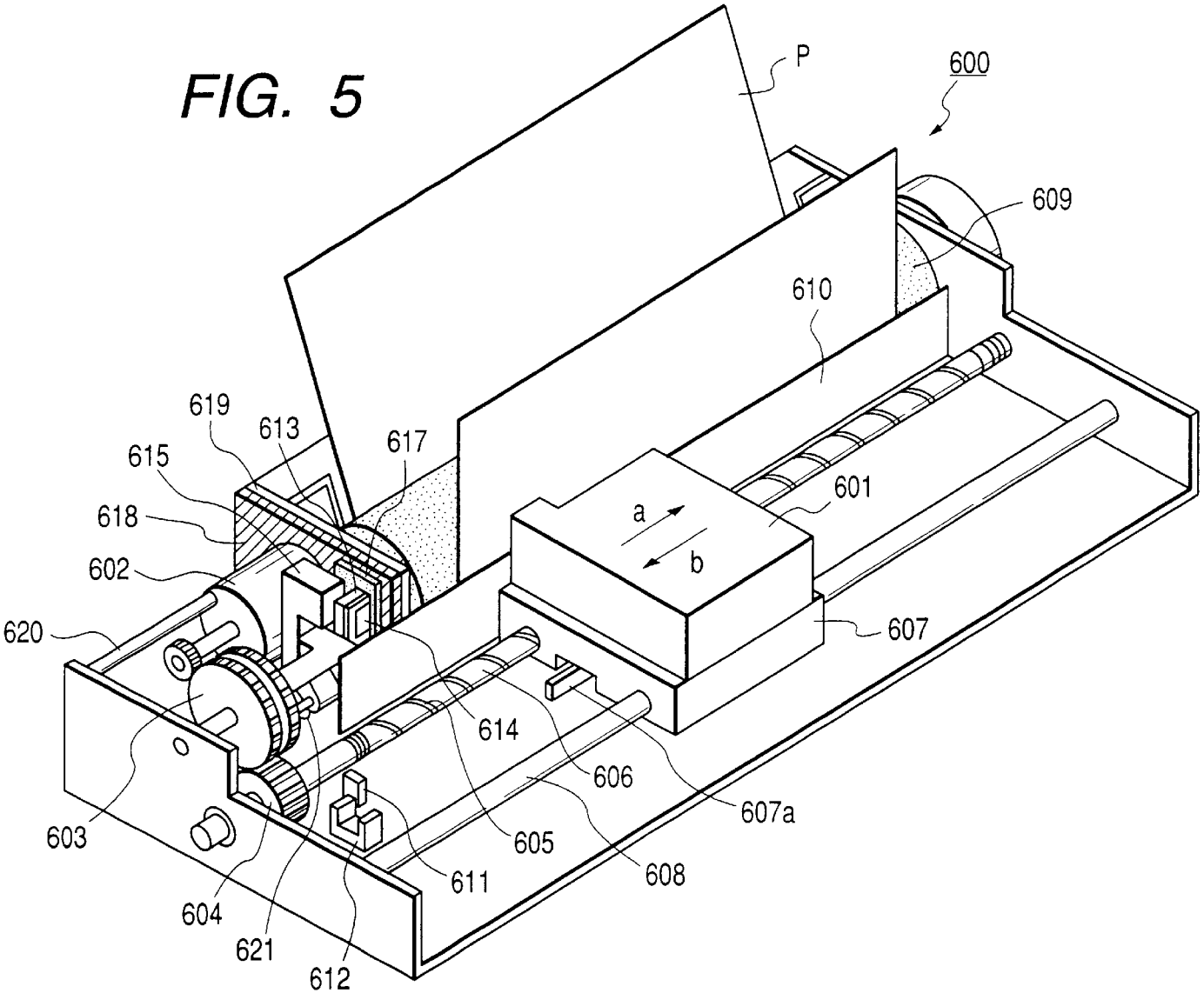
FIG. 5 is a perspective view which schematically shows one example of an ink jet recording apparatus having mounted thereon the ink jet recording head to which is the present invention is applicable.

FIG. 5 is a perspective view which schematically shows one example of an ink jet recording apparatus to which the ink jet recording head of the present embodiment is applicable and mountable thereon. In FIG. 5, a reference numeral 601 designates an ink head cartridge formed integrally with the ink jet recording head of the present embodiment, and an ink tank. The head cartridge 601 is mounted on the carriage 607 which engages with the spiral groove 606 of the lead screw 605 rotational through the driving power transmission gears 603 and 604 interlocked with the regular and reverse rotations of the driving motor 602. By the driving power of the driving motor 602, the cartridge is allowed to reciprocate together with the carriage 607 in the directions indicated by arrows a and b along the guide 608. The paper sheet pressure plate 610 for use of the printing sheet P, which is carried on the platen roller 609 by use of a recording medium feeding device which is not shown, is arranged to press the printing sheet P to the platen roller 609 in the traveling direction of the carriage.

In the vicinity of the one end of the lead screw 605, the photocouplers 611 and 612 are arranged, which serve as a home position detection means to confirm the presence of the lever 607*a* of the carriage 607 in the area where the couplers are arranged, hence switching the rotational directions of the driving motor 602.

In FIG. 5, a reference numeral 613 designates a supporting member that supports the cap member 614 that covers the front face of the ink jet recording head 601 where the discharge ports are arranged. Also, a reference numeral 615 designates ink suction means that sucks ink retained in the interior of the cap member 614 due to idle discharges or the like from the head 601. With the suction means 615, the suction recovery of the head 601 is executed through the inner aperture of the cap. A reference numeral 617 designates a cleaning blade; 618, a member for making the blade 617 movable in the forward and backward directions (the direction orthogonal to the traveling direction of the carriage 607). The blade 617 and the member 618 are supported by the main body supporting member 619. The blade 617 is not necessarily limited to the mode described above. It may be possible to adopt any known cleaning blade. A reference numeral 620 designates the lever which initiates suction when the suction recovery is performed, which is movable along with the movement of the cam 621 which engages with the carriage 607. The driving power of the driving motor 602 is transmitted thereto through known transmission means, such as clutching, thus controlling the movement thereof. The ink jet recording controller is provided for the apparatus main body to apply signals to the heat generating elements provided for the head 601 or to control the driving of each of the mechanisms described above. However, this controller is not shown here.

The ink jet recording apparatus 600 thus structured records on the recording material P which is carried on the platen 609 by use of the recording material carrying device which is not shown, while the head 601 travels to reciprocate on the entire width of the sheet P.

What is claimed is:

1. An ink jet recording head comprising:

a ceiling plate; and a substrate on a base plate substrate, having on the upper face thereof a plurality of discharge energy generating elements for discharging ink, said ceiling plate being provided with grooves to form a plurality of ink flow paths communicated with a plurality of ink discharge ports, respectively, and a recessed portion to form a common liquid chamber communicated with said plurality of ink flow paths, and when bonded with said substrate, the plurality of ink flow paths and said common liquid chamber being formed to discharge ink by means of said discharge energy generating elements for the execution of recording, wherein said base plate substrate is formed by a first base plate substrate and a second base plate substrate, and a thermal expansion coefficient of said first base plate substrate directly in contact with said substrate having said discharge energy generating elements arranged therefor is smaller than that of said second base plate substrate, and said first base plate substrate is formed by material having a thermal expansion coefficient closer to that of the substrate having said discharge energy generating elements arranged therefor, and said first base plate substrate, above which the discharge energy generating elements are placed, is supported by a surface of said second base plate substrate and a side face in the longitudinal direction of said second base plate substrate.

2. An ink jet recording head according to claim 1, wherein said substrate having the discharge energy generating elements arranged therefor is formed by silicon, and said second base plate substrate is formed by aluminum.

3. An ink jet recording head according to claim 2, wherein said first base plate substrate is formed by either one of amorphous carbon, aluminum nitride, and alumina.

4. An ink jet recording head according to claim 3, wherein said first base plate substrate has an X reference and a Y reference as criterion for an ink jet recording head.

5. An ink jet recording head according to claim 3, wherein said first base plate substrate and said second base plate substrate are bonded by a bonding agent capable of absorbing a difference in expansion due to the difference in the thermal expansion coefficients.

6. An ink jet recording head according to claim 1, wherein a wiring substrate is provided for said second base plate substrate, and said wiring substrate and said substrate are electrically connected.

7. An ink jet recording head according to claim 1, wherein said ink jet recording head has an arrangement density of discharge energy generating elements of 600 dpi or more.

8. An ink jet recording head according to claim 1, wherein said ink jet recording head has a recording width of one inch or more.

9. An ink jet recording head according to claim 1, wherein said substrate has an elongated recording width or has a higher recording density.

10. An ink jet recording apparatus comprising:

an ink jet recording head according to either one of claim 1 to claim 9, and a capping member for capping a discharge port formation portion of said ink jet recording head.

* * * * *